US006073517A

United States Patent [19]

Pauwels et al.

[11] Patent Number: 6,073,517

[45] Date of Patent: Jun. 13, 2000

[54] CONNECTION PIECE FOR CONNECTING A HOUSING OF A DRIVE UNIT TO A HOUSING OF A COMPRESSOR ELEMENT

[75] Inventors: Raphaël Henri Maria Pauwels, Bornem; Willy Joseph Rosa Bodart, Antwerp; Philip Xavier Jacques Veys, Poperinge, all of Belgium

[73] Assignee: Atlas Copco Airpower, naamloze vennootschap, Belgium

[21] Appl. No.: 09/078,712

[22] Filed: May 14, 1998

[30] Foreign Application Priority Data

May 20, 1997 [BE] Belgium ..... 9700435

[51] Int. Cl.[7] ..... F16H 57/02; F16F 7/00

[52] U.S. Cl. ..... 74/606 R; 403/3; 123/195 R; D15/149

[58] Field of Search ..... 74/606 R; D15/149, D15/148; 180/233; 123/195 R, 195 H; 403/3, 337

[56] References Cited

U.S. PATENT DOCUMENTS

| | | | |
|---|---|---|---|
| D. 103,338 | 2/1937 | Peterson | D15/149 |
| D. 277,487 | 2/1985 | Nilsson | D15/149 |
| D. 278,824 | 5/1985 | Votaw | D15/149 |
| D. 339,142 | 9/1993 | Middlebrook | D15/149 X |
| D. 377,657 | 1/1997 | Winters | D15/149 |
| 3,263,521 | 8/1966 | Muller . | |
| 3,942,502 | 3/1976 | Gorres et al. | 123/195 R |
| 4,467,754 | 8/1984 | Hayashi et al. | 123/195 H |
| 4,744,436 | 5/1988 | Uchiyama | 180/233 |
| 4,825,727 | 5/1989 | Komuro . | |
| 4,986,144 | 1/1991 | Kobayashi et al. | 74/606 R |
| 4,990,126 | 2/1991 | Ideta et al. | 475/210 |
| 5,044,228 | 9/1991 | Rugraff | 74/606 R |
| 5,203,441 | 4/1993 | Monette | 192/112 |
| 5,267,488 | 12/1993 | Hardeman et al. | 74/606 R |
| 5,447,078 | 9/1995 | Robinson et al. | 74/606 R |
| 5,566,591 | 10/1996 | Burkett | 74/606 R |
| 5,842,377 | 12/1998 | Hutchings et al. | 74/606 R X |
| 5,857,389 | 1/1999 | Antony et al. | 74/606 R |

FOREIGN PATENT DOCUMENTS 0 096 668 12/1983 European Pat. Off. .

OTHER PUBLICATIONS

Patent Abstract of Japan, vol. 18, No. 548 (M–1689) Publication No. 06193573, Publication Date Jul. 12, 1994 Application No. 04344612, Application Date Dec. 24, 1992.

*Primary Examiner*—Vinh T. Luong
*Attorney, Agent, or Firm*—Bacon & Thomas PLLC

[57] ABSTRACT

Connection piece for connecting a housing (4) of a drive unit (2) with a housing (5) of a compressor element (1). The connection piece is provided with ribs (12) over at least a part of its wall, the height of the ribs (12) being at least equal to one and a half times a thickness of the part of the wall upon which the rib is standing and the thickness of the ribs (12), half-way up the height, being equal to at least half of the thickness of the part of the wall. The ribs (12) form a pattern which divides the wall into adjacent wall segments (13) which have a first characteristic mode for bending that has a resonant frequency which excludes excitation by substantially all excitation frequencies up to and including a highest of the compressor element (1).

10 Claims, 4 Drawing Sheets

CONNECTION PIECE FOR CONNECTING A HOUSING OF A DRIVE UNIT TO A HOUSING OF A COMPRESSOR ELEMENT

BACKGROUND OF THE INVENTION

A) Field of the Invention

The present invention relates to a connection piece for connecting a housing of a drive unit to the housing of a compressor element.

Such connection pieces are used in compressor aggregates for connecting the housing (mostly made of cast metal) of a compressor element with the housing in which a drive unit of the compressor element is situated, for example, the housing of a motor. Due to the particular constructions of such housings, these housings cannot be manufactured as one whole unit.

B) Related Art

Typically, the coupling between the shaft or shafts of the rotor or rotors of the compressor element and the outgoing shaft or shafts of the drive unit is situated in the connection piece. Moreover, a gear-wheel transmission or another coupling transformer may also be integrated in the connection piece.

Compressor aggregates create a lot of noise. In order to restrict the noise level, vibration dampers are used for insulating the aggregate from the ground, and the framework is equipped with noise-restricting material. The channels through which ventilation air is sucked in are also acoustically treated.

Although these techniques already achieve a considerable noise dampening, the noise level of the compressor aggregate is still rather high.

In an effort to further reduce this noise level, research has been made which demonstrates that considerable noise energy is created in the compressor element. Because of the structural features of the whole aggregate, such noise energy is transformed into undesired vibrations and noise.

In particular, resonant frequencies of the structure of the aggregate are evoked by the pulsation frequencies of this compressor element, which leads to the radiation of superfluous noise energy.

It was noted that especially the connection piece between the housings of the compressor element and the drive unit is responsible for noise emission as well as transmission of vibrations and noise from the compressor element to the motor and to the support points of the connection piece.

BRIEF SUMMARY OF THE INVENTION

The present invention aims at a connection piece in which noise radiation and transmission of vibrations are minimal, such that the noise emission of the compressor aggregate is reduced.

This aim is achieved according to the invention by a connection piece which, on at least a part of its wall, is provided with ribs whereby the height of every rib is at least equal to one and a half times the thickness of the wall part upon which the rib is standing and the thickness of every rib, halfway up its height, is equal to at least half of the thickness of the wall part upon which the rib is standing, whereby the ribs form a pattern which divides the wall into adjacent wall segments which have a first characteristic mode for bending that has a resonant frequency which excludes excitation by substantially all excitation frequencies up to and including the highest of the compressor element.

Preferably, the ribs are provided on the connection piece in such a manner that the segments which are bordered by these ribs at least take up half of its wall.

The ribs may be provided at the outer side or the inner side.

The connection piece may be formed of a tubular part with two flanges at the extremities thereof, whereby, for example, at least the lateral flanks of the tubular part are provided with ribs.

BRIEF DESCRIPTION OF THE DRAWINGS

With the intention of better showing the characteristics of the invention, hereafter, by way of example without any limitative character, several preferred embodiments of a connection piece arranged between a compressor element and a drive unit according to the invention are described, with reference to the accompanying drawings, wherein.

DETAILED DESCRIPTION

Figure 1:
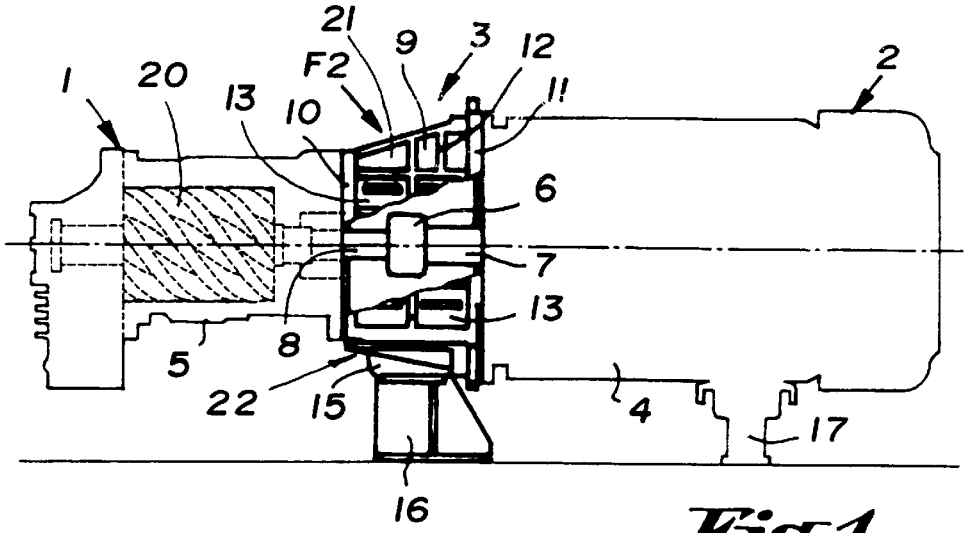
FIG. 1 schematically represents a compressor aggregate with a connection piece according to the invention.

In FIG. 1, a compressor aggregate is represented consisting of a compressor element 1, for example, a scroll compressor element with one rotor or a screw compressor element with two rotors, a drive unit 2 formed by an electric motor, and a connection piece 3 connecting a housing 4 of the drive unit 2 to a housing 5 of the compressor element 1. A coupling 6 is situated in the connection piece 3 between an outgoing shaft 7 of the drive unit 2 and a shaft 8 of a rotor 20 of the compressor element 1.

In the case that the compressor element 1 is a screw compressor and thus comprises two rotors, the shaft 8, by a gearwheel transmission, a belt transmission or another coupling transformer, may drive the shaft of a rotor.

The connection piece 3 may comprise a tubular part 9 with a flange 10 at one extremity for fixation onto the housing 5 of the compressor element 1, and a flange 11 at the other, somewhat larger extremity for fixation onto the housing 4 of the drive unit 2.

The acoustic energy created by the compression process of a compressor element is rather tonal and is a composition of deterministic signals. The lowest deterministic signal, the fundamental tone, is a sinusoid with a basic frequency equal to the rhythm with which the compressor elements sucks air from the environment and expels it into the outlet of the compressor element.

The air is compressed in the compression chamber and expelled rather abruptly into the outlet such that the compression process is not performed in a progressive manner. As a consequence, harmonic components of the fundamental tone are created. These harmonic components have a frequency which is an integral multiple of the basic frequency.

Depending on a multitude of processes and geometric parameters, more or less harmonics are created with amplitudes which may or may not be important with respect to the fundamental tone. The total tonal energy causes the housing 5 of the compressor element 1 and the flanged-on structures to vibrate which, each in its own manner, transform the energy into vibrations and noise.

In order to restrict such vibrations, ribs 12 are provided on a part, preferably on more than half, of the wall of the tubular part 9 according to a pattern which divides the outer side between the flanges 10 and 11 into adjacent wall segments 13.

In the represented example, the ribs 12 are provided on the outer side of the wall of the tubular part 9, but they may also be situated at the inner side.

Figure 6:
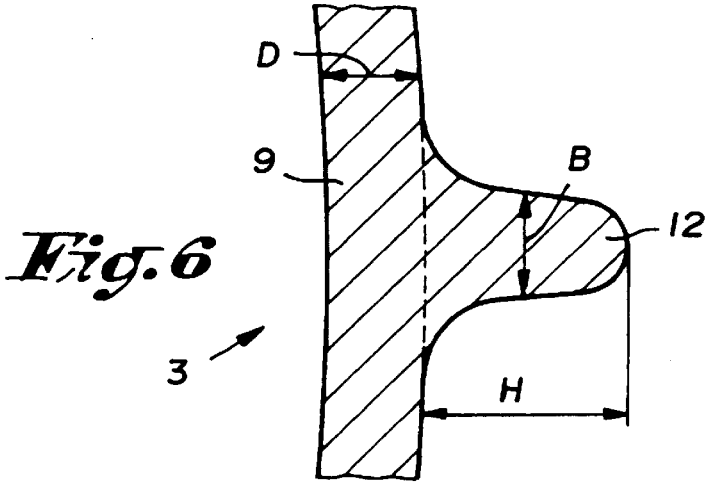
FIG. 6, on a larger scale, represents a cross-section according to line VI—VI in FIG. 2.

These ribs 12 meet specific requirements. As represented in detail in FIG. 6, the height H of each rib 12 is at least one and a half times, for example two times, the thickness D of the wall part upon which the rib 12 is standing, and the width B of each rib 12, measured half-way up the height of the rib 12, is at least half of thickness D, for example equal to the thickness D.

Considering the fact that the connection piece 3 may be a metal cast part, the ribs 12 may widen somewhat towards their bases because of casting techniques. The top of the ribs 12 may be rounded off, and the ribs 12 may connect with a rounded part to the wall part upon which they are standing.

The aforementioned pattern formed by the ribs 12 also meets specific requirements: namely, the pattern has such a dense structure that the first characteristic mode for bending for each wall segment 13 has a resonant frequency which is such that no wall segment 13 may be excited by any excitation frequencies up to and including the highest of the compressor element 1.

The highest harmonic, in other words, the excitation component of the highest frequency, is thus no longer able to start the so-called breathing mode or first bending mode of any wall segment 13. As a result, the wall segments 13 cannot radiate any considerable noise.

Each wall segment 13 will start vibrating when excited with a dynamic force. When the supplied vibration takes a frequency equal to one of the resonant frequencies of the wall segment 13, considerably more noise is radiated than the noise radiated by the wall segment 13 for any other frequency.

The characteristic mode is the manner in which a wall segment vibrates with one of its resonant frequencies and differs from resonant frequency to resonant frequency.

The characteristic mode of the first resonant frequency is a typical bending mode, whereby the central point of the wall segment 13 performs an up-and-down movement and whereby all other points of this wall segment 13 perform a smaller movement which, however, is in phase with the movement of the central point. The first characteristic mode is also indicated as the "breathing mode".

Thus, the aforementioned pattern depends on the characteristics of the compressor element 1, such as the rotational speed and the rotor construction, which exert an influence upon the excitation frequency of the compressor element 1.

Most of the wall segments 13 may be provided with a groove 14 for internal cooling of the connection piece 3.

In the represented example, the ribs 12 and, thus, the wall segments 13 are present on the lateral flanks 21 of the tubular part 9. The one lateral flank consists of parts forming an angle with each other. An upper side and underside of the tubular part 9 have flat parts.

With a lower one of such flat parts, an underneath part 22, the connection piece 3 rests on a support 16 with the intermediary of an elastic cushion 15, as represented in FIG. 1. In an analogous manner, the housing 4 of the drive unit 2 rests upon a second support point 17.

It is clear that the ribs 12 and, thus, the wall segments 13 may be situated also, or exclusively, at the upper and/or bottom side of the tubular part 9.

The flange 11 substantially extends outwardly with respect to the opening of the tubular part 9 on the corresponding extremity of the tubular part 9. The flange 11 has four openings 18, each provided with a screw thread on the inside, for fixation of the housing 4 thereupon by bolts.

The flange 10, on the contrary, is asymmetrical with respect to the opening of the tubular part 9 on the extremity concerned. In other words, the flange 10 protrudes outwardly at one of the lateral flanks 21 and protrudes inwardly at the other one of the lateral flanks 21.

Openings 19 are provided in the flange 10 for fixation of the flange 10 on the housing 5 by bolts.

The heretofore described connection piece 3 provides a considerable reduction of the noise radiation as a consequence of its particular structure.

The connection piece 3 need not necessarily be situated in the prolongation of the compressor element 1 and the drive unit 2. It may be situated, for example, next to, under or above the compressor element 1 and the drive unit 2. In such a case, the coupling 6 is formed by a transmission.

Figure 7:
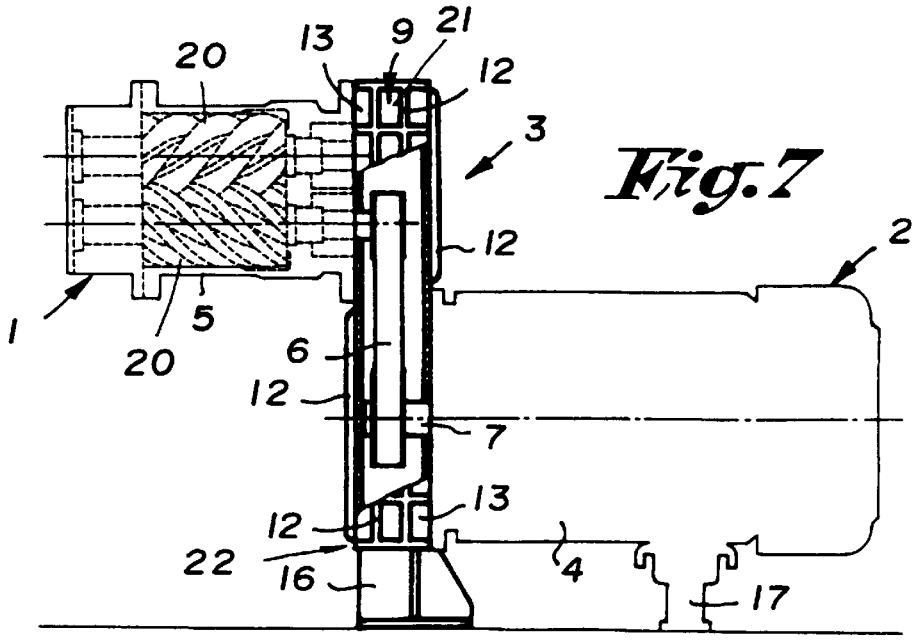
FIG. 7 schematically represents a compressor aggregate analogous to FIG. 1, but in respect to another embodiment.
Figure 2:
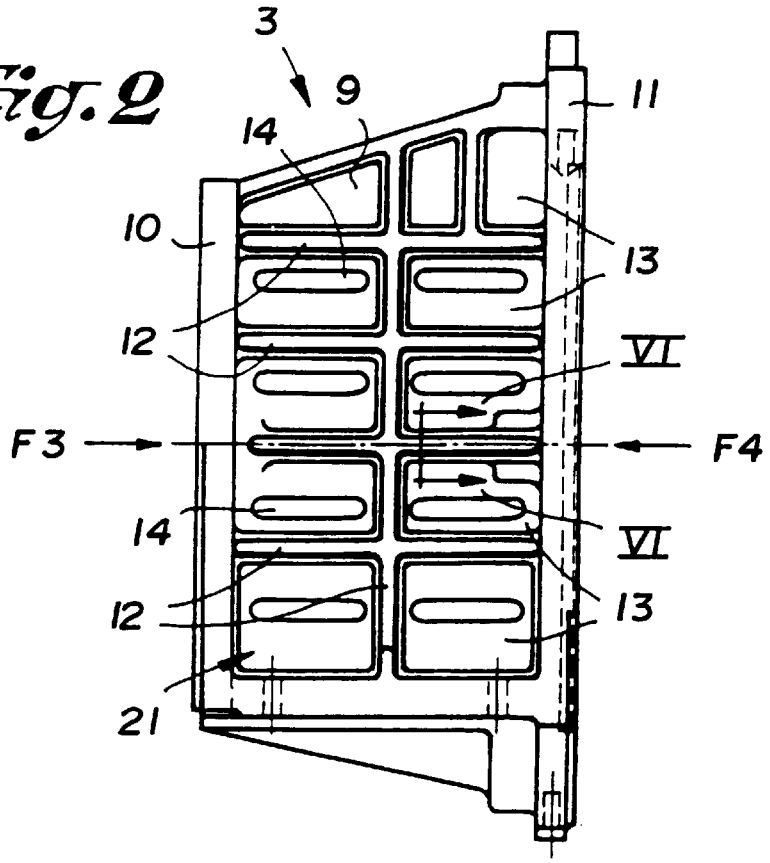
FIG. 2, on a larger scale, represents a side elevational view of the connection piece of the compressor aggregate of FIG. 1.
Figure 3:
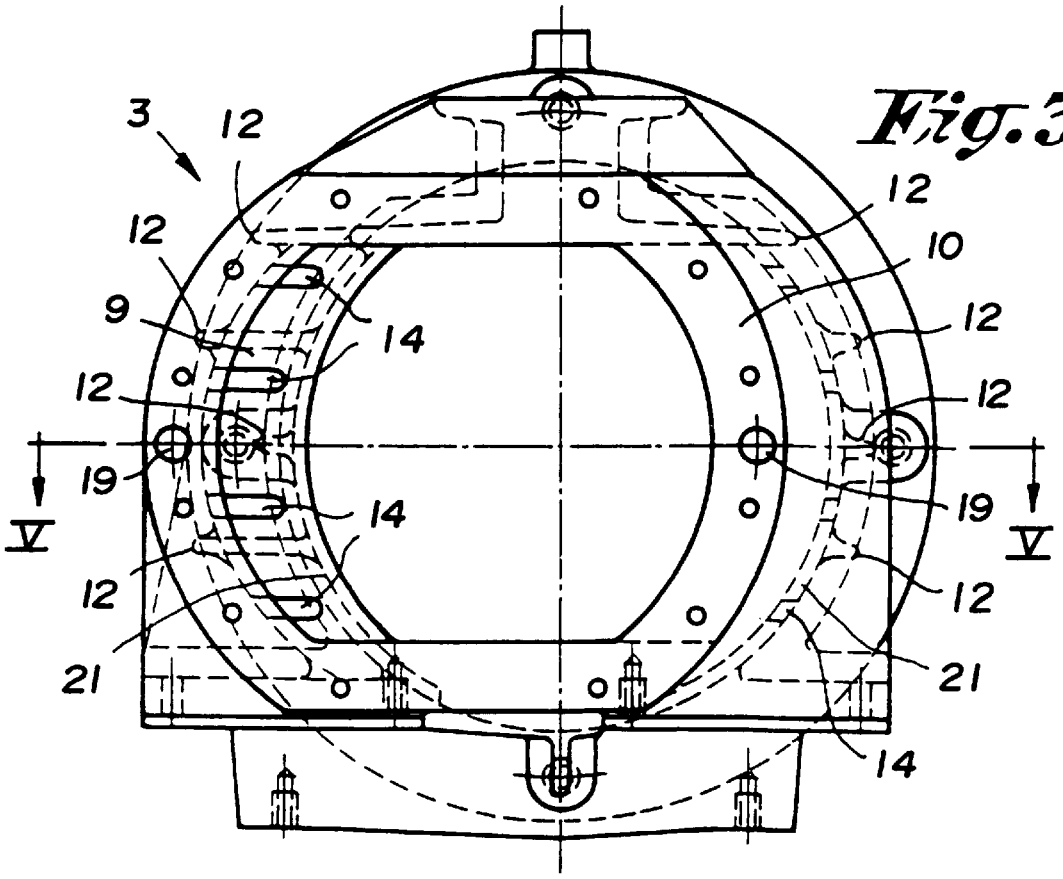
FIG. 3 represents a view according to arrow F3 in FIG. 2.
Figure 4:
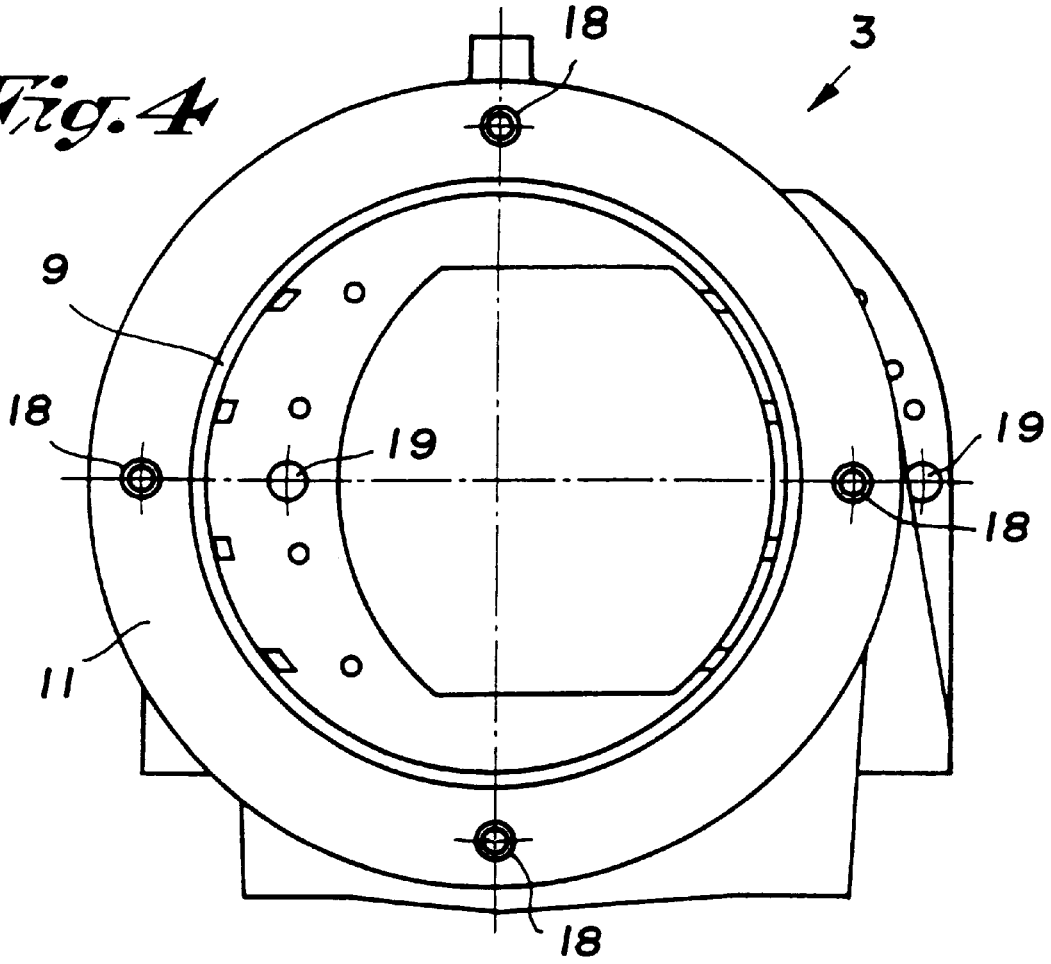
FIG. 4 represents a view according to arrow F4 in FIG. 2.
Figure 5:
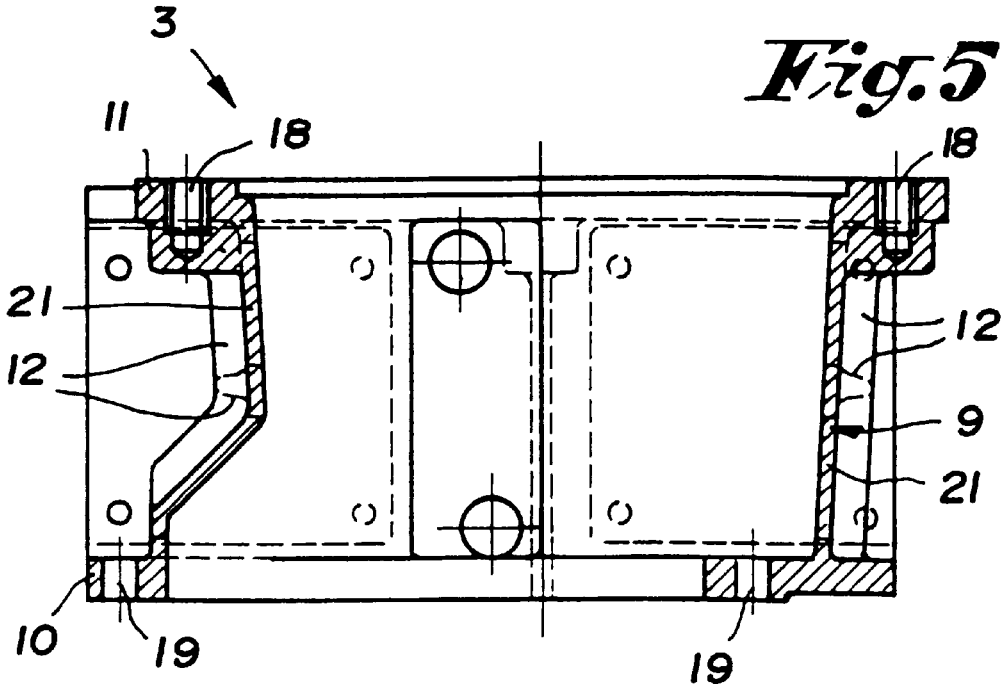
FIG. 5 represents a cross-section according to line V—V in FIG. 3.

For example, in FIG. 7, an embodiment of a compressor aggregate is represented schematically, whereby the compressor element 1 and the drive unit 2 are not situated in their mutual prolongation and the connection piece 3 has a form different than described heretofore.

In this embodiment, the connection piece 3 has the shape of a flat box in which the coupling 6, which is formed by a belt transmission, is situated.

The compressor element 1 is fixed, by a flange and bolts, on top, on one side of this box. The shaft 8 of a rotor extends through an opening into the aforementioned side.

The drive unit 2 is fixed in an analogous manner by a flange and bolts, at the lower end, on the other side of the connection piece 3. The outgoing shaft 7 extends through an opening into the last-mentioned side.

On the lateral edge, as well as on the two aforementioned sides, next to the compressor element 1 and the drive unit 2, ribs 12 are provided which define adjacent wall segments 13.

As far as the dimensions as well as the pattern are concerned, the ribs 12 meet the same requirements as in the embodiment according to FIGS. 1 to 6.

In this case, too, the ribs 12 considerably reduce the noise radiation and/or transmission.

Figure 8:
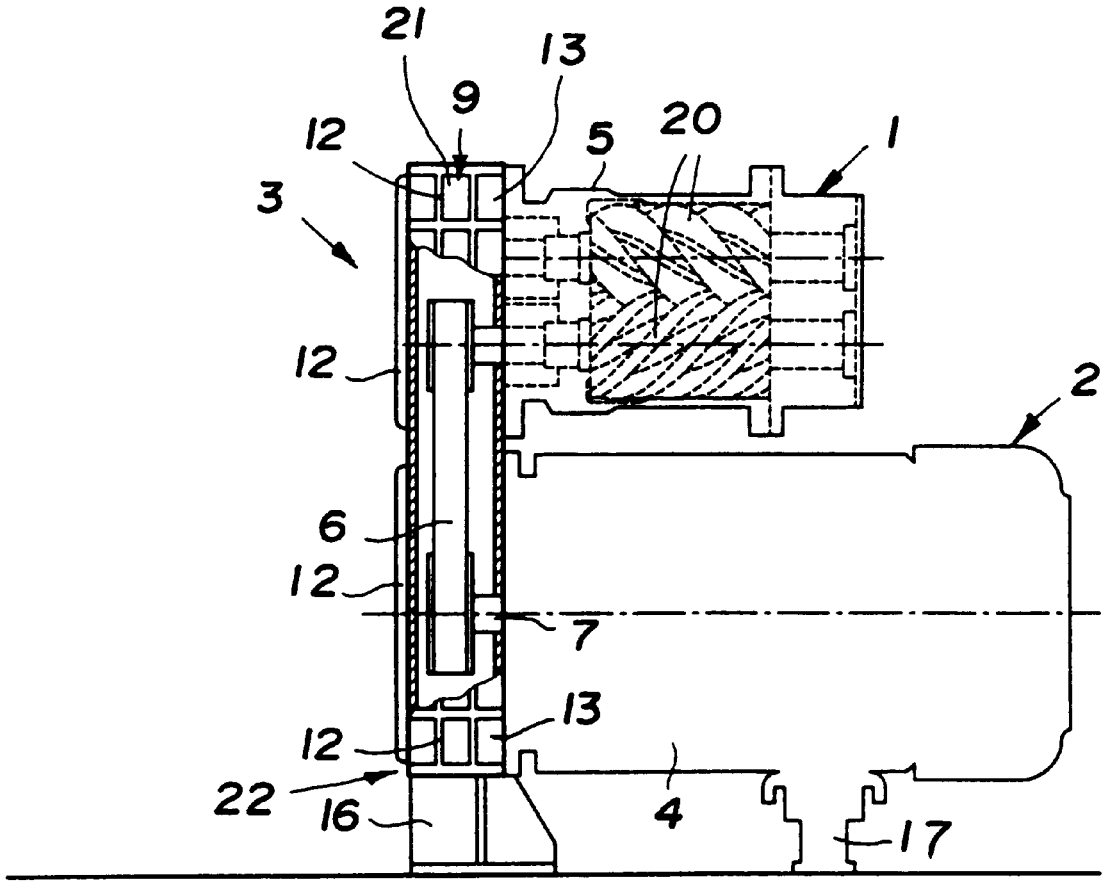
FIG. 8 schematically represents a compressor aggregate wherein the compressor element and the drive unit are disposed on a same side of the connection piece according to the invention.

In a variant, the compressor element 1 and the drive unit 2 may be situated above or next to each other at the same side of the connection piece 3. This is illustrated in FIG. 8.

The present invention is in no way limited to the embodiments described heretofore and represented in the figures; on the contrary, the connection piece of the invention may be realized in various other embodiments without leaving the scope of the invention.

We claim:

1. A connection piece for connecting a housing of a drive unit with a housing of a compressor element, the connection piece comprising:

a wall which is provided with ribs over at least a part thereof, each of the ribs having a height which is at least equal to one and a half times a thickness of the part of the wall upon which the rib is standing and each of the ribs having a thickness which, half-way up the height is equal to at least half of the thickness of the part of the wall upon which the rib is standing, whereby the ribs form a pattern which divides the wall into adjacent wall segments, the wall segments having a first characteristic mode for bending which has a resonant frequency which excludes excitation by substantially all excitation frequencies up to and including a highest of the compressor element.

2. The connection piece according to claim 1, wherein the ribs are provided in such a manner that the wall segments which are determined thereby take up at least half of the wall.

3. The connection piece according to claim 1, wherein the ribs are provided on an exterior side of the wall.

4. The connection piece according to claim 1, wherein the ribs are provided on an interior side of the wall.

5. The connection piece according to claim 1, which is formed of a tubular part with extremities and two flanges at the extremities.

6. The connection piece according claim 5, wherein the tubular part has lateral flanks, the ribs being provided at least on both lateral flanks.

7. The connection piece according to claim 1, further comprising:

a coupling situated therein, the coupling being adapted to form a connection between an outgoing shaft of the drive unit and a shaft of a rotor of the compressor element.

8. The connection piece according to claim 1, further comprising:

an underneath part;

an elastic cushion; and a support, whereby the connection piece rests with the underneath part on the support via the elastic cushion.

9. The connection piece according to claim 1, wherein the connection piece forms a box which is adapted to have the compressor element and the drive unit fixed on a same side of the box.

10. The connection piece according to claim 9, wherein the connection piece forms a box which is adapted to have the compressor element and the drive unit fixed on different sides of the box.

* * * * *